United States Patent [19]

Wheeler et al.

[11] 4,410,121

[45] Oct. 18, 1983

[54] SPIRAL COIL STRIP ACCUMULATOR AND METHOD

[75] Inventors: Donald J. Wheeler, Belton, S.C.; Christopher Cooper, Brunswick; Charles R. Krejsa, Northfield, both of Ohio

[73] Assignee: Guild International Inc., Bedford, Ohio

[21] Appl. No.: 297,234

[22] Filed: Aug. 28, 1981

[51] Int. Cl.[3] ..... B65H 17/42; B65H 75/02

[52] U.S. Cl. ..... 226/118; 242/55

[58] Field of Search ..... 226/118, 119, 189; 242/55, 47.01, 55.01, 55.19 R

[56] References Cited

U.S. PATENT DOCUMENTS

| | | | |
|---|---|---|---|
| 2,363,403 | 11/1944 | DeNapoli | 242/55.19 R |
| 3,506,210 | 4/1970 | LaTour | 242/55 |
| 3,729,144 | 4/1973 | Bijasiewicz | 242/55.19 R |
| 4,097,007 | 5/1978 | Weatherby | 242/55 |
| 4,288,042 | 9/1981 | Sendzimir | 242/55 |

*Primary Examiner*—Stuart S. Levy
*Assistant Examiner*—Lloyd D. Doigan
*Attorney, Agent, or Firm*—Maky, Renner, Otto & Boisselle

[57] ABSTRACT

A strip accumulator and method characterized by a plurality of circumferentially arranged strip guide basket assemblies which positively define a spiral path for the strip material with adjacent turns thereof being maintained in spaced relation, and means for uniformly moving the strip guide basket assemblies radially to expand and contract the helical path for the strip material so that a reserve capacity of strip material may be stored in the accumulator and withdrawn as needed to provide for continuous feed of the strip material to a continuous processing line and the like despite interruptions in the in-feed to the accumulator as when the end of the coil is reached and a new coil is required to be welded thereon. The strip accumulator consists of a plurality of equally circumferentially spaced roll support columns or frames for the strip guide basket assemblies that are mounted for radial movement on rails and provided with one or more guide roll assemblies at various elevations and angles which contain, support and guide the strip material along such spiral path or, more accurately, a helical path. Uniform radial movement of the frames may be obtained by a common drive and drag brake assembly connected to each frame by a bi-directional cable and capstan arrangement, such being operative to drive the frames radially outwardly during filling of the accumulator, and place a drag on the frames as they are drawn radially inwardly during emptying of the accumulator. Also provided are entry and exit roll guides which are mounted on rails and coupled to respective vertical frames at the entry and exit to the helical strip path for common radial movement with such frames.

25 Claims, 3 Drawing Figures

SPIRAL COIL STRIP ACCUMULATOR AND METHOD

This invention relates generally to a strip accumulator and, more particularly, to a strip accumulator by which a length of strip material being fed from a source of supply, such as an uncoiler, to a mill, machine or other apparatus which processes or uses the strip material, is stored in an expanding and contracting spiral coil so that the mill, machine or other apparatus can be kept running without interruption while the source of strip material is being replenished. Such a strip accumulator may be employed, for example, in a continuous processing line to allow strip material to be continuously fed through the line even while the tail end of the spent coil of the strip material is stopped to permit the lead end of a new coil of strip material to be welded or otherwise attached to such tail end.

BACKGROUND OF THE INVENTION

Strip accumulators heretofore have stored a length of strip material in an expanding and contracting spiral coil having a fixed number of turns with the strip material being fed to the inside of the spiral coil and withdrawn from the outside, or vice versa. Typically, the maximum diameter of the outermost turn of the spiral coil is determined by an outer containment ring or circular array of outer containment rollers whereas the inner diameter of the innermost turn of the spiral coil is determined by an inner containment ring or circular array of inner containment rollers. Accordingly, the difference between the length of coil when fully expanded into engagement with the outer containment ring or rollers and when fully contracted against the inner containment ring or rollers determines the maximum reserve storage capacity of the accumulator for any given gauge and number of turns of the strip material. It of course will be understood that the radial dimension of the space occupied by such given number of turns in the spiral coil when the turns are closely packed must be less than the difference between the maximum and minimum permissible radii of the spiral coil defined by the outer and inner containment rings or rollers. Such inner and outer containment rings or rollers typically are mounted in the accumulator at respective fixed diameters. However, it is known to mount inner containment rollers for slight radial movement so that they can be radially retracted away from the contacted spiral coil just prior to resumption of strip feed-in to the inside of the spiral coil following attachment of a new coil of strip material to the end of the spent coil.

In one known type of strip accumulator disclosed in United Kingdom patent specification No. 1,386,250, an annular ring or array of long, thin, cylindrical rollers support a single spiral coil of strip material with the axis thereof oriented vertically, and such rollers are synchronously driven by individual variable-speed electric motors to rotate the spiral coil of strip material supported thereon to facilitate feeding and withdrawal of the strip material from the spiral coil. The rollers extend radially, or may be slightly skewed, and slope downwardly and outwardly to urge the turns of the spiral coil stored thereon outwardly as the rollers rotate.

It is also known to guide the incoming strip material by a support cage mounted above the individually driven rollers and feed the strip material to the inside of the spiral coil and withdraw the strip material from the outside, or vice versa. Such support cage includes a driven pair of feed-in or pinch rollers and one or more pairs of fixedly mounted guide idler rollers which define a desired helical path of the strip material from the pinch rollers to the individually driven rollers supporting the spiral coil.

Although such an accumulator will operate satisfactorily, it is relatively expensive to manufacture and is subject to misoperation. In particular, the individually driven rollers and drives therefor are expensive, and sophisticated controls are required to achieve proper synchronization of the rollers. Moreover, the turns of the spiral coil of strip material are not positively controlled, and undesirable interface friction exists between adjacent closely packed turns of the spiral coil, which may also cause the surfaces of the strip material to become marred, blemished or otherwise damaged as a result of the rubbing that occurs between adjacent turns of the spiral coil.

SUMMARY OF THE INVENTION

The present invention provides a strip accumulator having desirable operational characteristics which is relatively inexpensive and simple in construction. The strip accumulator eliminates the need for expensive individually driven drive rollers and sophisticated controls therefor, and provides for continuous positive control of the strip material with no interface friction between adjacent turns.

Briefly, a strip accumulator and associated method according to the invention are characterized by a plurality of circumferentially arranged strip guide basket assemblies which positively define a spiral path for the strip material with adjacent turns thereof being maintained in spaced relation, and means for uniformly moving the strip guide basket assemblies to radially expand and contract the spiral path for the strip material. As the diameter of the spiral strip path is increased or decreased, the length of accumulated strip material proportionally increases or decreases. Accordingly, strip material may be withdrawn without continuous in-feed by uniformly moving the strip guide basket assemblies to effect radial contraction of the spiral strip path, such as during attachment of a new coil of strip to the tail end of a spent coil of strip. At all times during radial expansion and contraction of the spiral basket path, adjacent turns of the strip material are maintained in spaced relation whereby no interface friction exists between adjacent turns.

More particularly, a preferred form of strip accumulator comprises a plurality of equally circumferentially spaced roll support columns or frames which are mounted on respective tracks or rails for radial movement. The roll support frames are provided with one or more guide roll assemblies at various elevations and angles which contain, support and guide the strip material along the spiral path or, more accurately, a helical path wherein adjacent turns are maintained in vertically spaced relation. Uniform radial movement of the frames is obtained by a common drive and drag brake assembly connected to each frame by a bi-directional cable and capstan arrangement, such being operative to drive the frames radially outwardly during filling and place a drag on the frames as they are moved radially inwardly during emptying of the accumulator. Also provided are entry and exit roll guide assemblies which are mounted on rails and coupled to respective vertical frames at the entry and exit to the helical strip path for common radial movement with such frames.

To the accomplishment of the foregoing and related ends, the invention, then, comprises the features hereinafter fully described and particularly pointed out in the claims, the following description and the annexed drawings setting forth in detail a certain illustrative embodiment of the invention, this being indicative, however, of but one of the various ways in which the principles of the invention may be employed.

DETAILED DESCRIPTION

Figure 1:
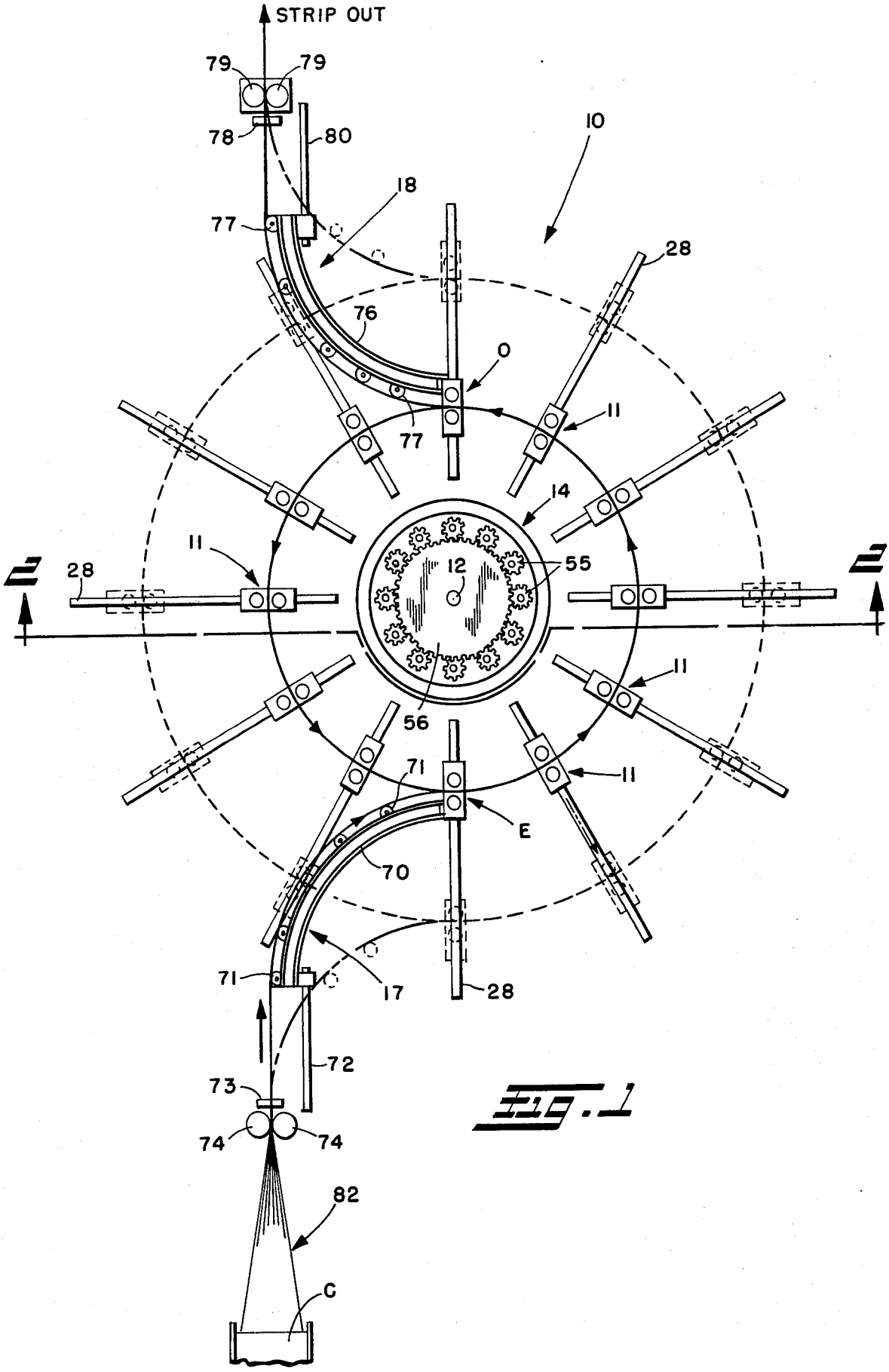
FIG. 1 is a schematic plan view of a preferred form of strip accumulator according to the present invention.

As used herein, the terms vertical, vertically, horizontal, horizontally, radial, radially, normal, perpendicular and the like will mean, respectively, vertical and substantially vertical, vertically and substantially vertically, and so on, unless otherwise specifically stated.

Referring now in detail to the drawings, there is shown a preferred embodiment of strip accumulator 10 in accordance with the present invention for storing a length of strip material, such as sheet metal strip S, taken from a coil C, and supplying such strip material to a mill, machine or other apparatus without interruption.

General Arrangement of Strip Accumulator 10

As shown, the strip accumulator 10 comprises a plurality of strip guide basket assemblies which are commonly identified by reference numeral 11. The strip guide basket assemblies 11 are circumferentially arranged and uniformly radially movable with respect to the central vertical axis 12 of the accumulator by a frame drive assembly 14. Each strip guide basket assembly 11 includes a fabricated vertical roll support carriage or frame 15 as well as one or more guide roll assemblies 16 which together define a helical path for the strip material S. The guide roll assemblies 16 contain, support and guide the strip material along the helical strip path from a strip entry roll guide 17 to a strip exit roll guide 18.

In the illustrated embodiment, the guide roll assemblies 16 are set or mounted on the vertical frames 15 to define a helical path consisting of one and one-half turns of the same diameter with adjacent turns being maintained by the guide roll assemblies in vertically spaced relation. Accordingly, the entry and exit roll guides 17 and 18 are positioned 180° apart with respect to the accumulator axis 12. However, the entry and exit roll guides may be positioned at any angle desired, and the number of turns may also be varied as desired. Also in the illustrated embodiment, the guide basket assemblies number twelve; however, there may be more or fewer guide basket assemblies depending for example on the size and type of strip material to be used. As shown, such guide basket assemblies are preferably circumferentially equally spaced.

The Vertical Frames 15

The vertical frames or carriages 15 of the strip guide basket assemblies 11 are of like construction and accordingly like reference numerals are used to designate corresponding like elements of such frames.

Each vertical frame 15 may include laterally spaced pairs of elongate vertical side frame members 20 and 21. Such side frame members are interconnected top and bottom by a top plate or cap 22 and a bottom plate 23, respectively, to form a rectilinear vertical column. In addition, each frame includes large laterally spaced triangular plates or gussets 24 and 25 secured to the radially outer and inner frame members 20 and 21, respectively. Each respective pair of laterally spaced gussets may be interconnected by additional frame elements (not shown) to form a rigid structure and extend radially in opposite directions to provide a broad base radial support for the vertical column of the frame.

Figures 2, 3, 4:
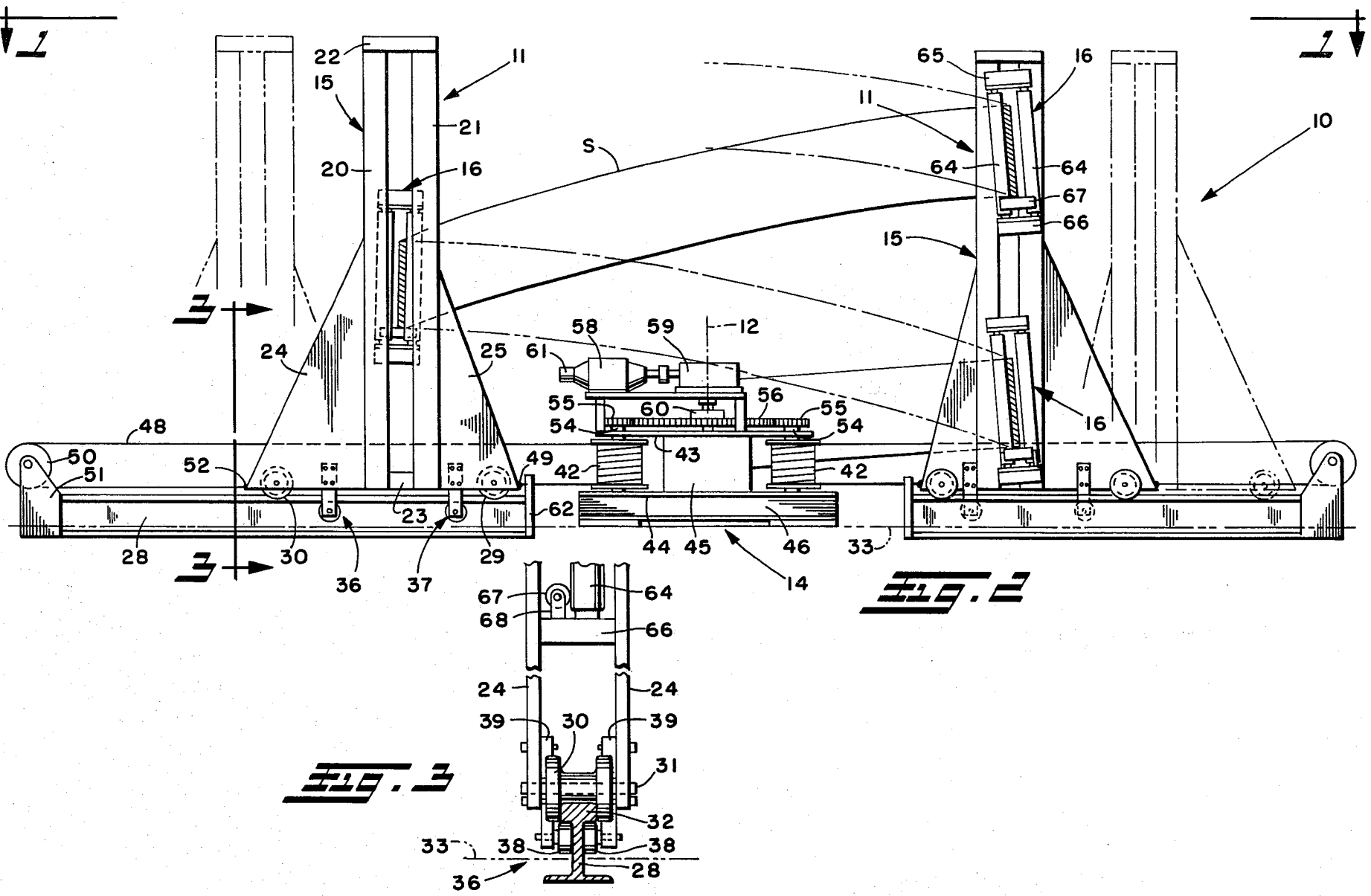
FIG. 2 is an enlarged vertical section through the accumulator of FIG. 1 taken substantially along the line 2—2 thereof.
FIG. 3 is an enlarged fragmentary vertical section through the accumulator taken substantially along the line 3—3 of FIG. 2.

The vertical frame or carriage 15 of each guide basket assembly 11 is supported for radial movement on a corresponding rail or track 28 as by means of radially inner and outer captive flange rollers 29 and 30, respectively. As seen in FIG. 3, the radially outer roller 30 is mounted for rotation on an axle or shaft 31 secured between the laterally spaced gussets 24 at the radially outer ends thereof, and rides on the top flange 32 of the rail which may be set in the foundation 33 as shown or otherwise fixedly secured to the foundation. The radially inner roller 29 is similarly mounted between the laterally spaced gussets 25 at the radially inner ends thereof and also rides on the top flange of the rail.

Each vertical frame 15 further is mounted on the corresponding rail 28 by two sets of rollers indicated at 36 and 37 in FIG. 2. The roll sets are similar, and, as seen in FIG. 3, each set includes rollers 38 which are mounted for rotation at the lower ends of depending brackets 39 which are respectively secured to the gussets 24 and 25 on opposite sides of the rail 28. Such rollers respectively bear against the undersides of the oppositely projecting side portions of the top flange 32 of the rail to hold the vertical frame to the rail and to maintain the frame upright.

Accordingly, the roller sets 36 and 37 cooperate with the radially spaced rollers 29 and 30 to hold the vertical frames 15 in their upright position whereas the latter rollers also hold the frames against lateral movement with respect to the rail 28. Therefore, the vertical frames are constrained for movement only along the rails. As the rails radiate from the central vertical axis 12 of the accumulator as seen in FIG. 1, the vertical frames are thus constrained for radial movement which is effected uniformly by means of the frame drive assembly 14 as described hereafter.

The Frame Drive Assembly 14

As seen in FIG. 2, such frame drive assembly 14 may comprise a capstan 42 for each vertical frame 15 which has its top and bottom end journals supported by top and bottom circular journal plates 43 and 44. The top and bottom journal plates are maintained in vertically spaced relationship by a vertical cylinder 45 and are supported on a base 46 in the center of the accumulator.

As shown, such circular journal plates 43 and 44 support the capstans 42 in a circular array, each capstan being generally in radial alignment with a corresponding vertical frame 15 and rail 28. Wrapped around each capstan is a cable 48 having one end connected to the radially inner end of the vertical frame as at 49. The other end of the cable is trained about a pulley 50 journaled in a bracket 51 mounted at the radially outer end of the rail 28 and is connected to the radially outer end of the vertical frame as at 52. Accordingly, rotation of the capstan in one direction corresponds to radial inward movement of the vertical frame whereas rotation in the opposite direction corresponds to radial outward movement of the vertical frame.

As seen in FIG. 2, the top end journal 54 of each capstan 42 projects above the top circular plate 43 and has secured thereto a pinion 55. Each pinion associated with each capstan is in mesh with a common central gear 56 whereby rotation of such common gear effects uniform rotation of the pinions and accordingly the capstans coupled thereto, to cause uniform radial movement of the vertical frames 15 through the bi-directional cables 48.

The common gear 56 may be drivingly connected to a motor 58 through a gear reducer 59 and a drag brake and clutch mechanism 60. As will be appreciated below, the motor need only operate to drive the frames radially outwardly during filling of the accumulator. During emptying of the accumulator, i.e., during radially inward movement of the vertical frames 15, the motor is disengaged by the clutch and the drag brake places a drag on the common gear so that the capstans will not free wheel and the cables fly as a result of the forces being exerted by the radially collapsing strip on the vertical frames as the strip is withdrawn from the accumulator at a rate faster than it is fed into the accumulator. If desired, a brake 61 also may be provided to hold the vertical frames in their fully expanded condition, for example, so that the drive motor may be turned off during normal operation when strip material is fed into and withdrawn from the accumulator at equal rates.

Although suitable controls for the frame drive assembly 14 desirably are provided to control the end limits of movement of the vertical frames 15 along the rails 28, there additionally may be provided at the radially inner end of each rail a radially inner stop 62 which may define the smallest diameter of the accumulator and is selected so that no permanent deformation of the stored strip will occur at such smallest diameter. The bracket 51 may function as a radially outer stop.

The Guide Roll Assemblies 16

Like the vertical frames 15, the guide roll assemblies 16 may be substantially identical, and accordingly like reference numerals are used herein to designate corresponding like elements thereof.

Each guide roll assembly 16 includes a pair of parallel guide rolls 64 which are radially in line with respect to the accumulator central axis 12 and closely spaced to contain and guide the strip material S in a narrow path therebetween. The guide rolls 64 are mounted between upper and lower roll end supports 65 and 66 which are secured between the opposed pairs of side frame members 20 and 21. Preferably, the roll end supports include heavy duty roller bearing pillow blocks in which the end journals of the rolls 64 are supported. The guide rolls preferably are large diameter rolls of the segmented type which consist of alternate sections of steel and polyurethane.

Each guide roll assembly 16 further includes a radially extending lower strip edge support roll 67 which may be mounted by brackets 68 on the lower roll end support 66 adjacent the lower ends of the rolls 64 as shown in FIG. 3. The axis of such edge support roller 67 is normal to the axis of the guide rolls 64.

As previously indicated, the guide roll assemblies 16 are set in the vertical frames 15 to define a spiral path or, more accurately, a downwardly descending helical path consisting of one or more turns of essentially the same diameter. In the embodiment shown, the helical path has its entry and exit at vertically spaced points along the entry and exit guide assemblies indicated respectively at E and O in FIG. 1, and includes one and one-half turns as seen in FIG. 2. Accordingly, some of the vertical frames may have mounted thereon two or more guide roll assemblies 16 for supporting two or more vertically spaced portions of the strip turns such as seen at the right in FIG. 2, whereas some may have only one guide roll assembly as seen at the left in FIG. 2, depending on the number of turns. As seen in FIG. 2, such guide roll assemblies preferably are skewed slightly to the vertical, as required, to define the proper helical strip path.

Entry and Exit Roll Guides 17 and 18

As seen in FIG. 1, strip material S is fed into the helical strip path by the entry roll guide 17. Such guide desirably includes a fabricated frame 70 which supports an arcuate array of spaced vertical rolls 71. The radius of the frame is sufficiently large so as not to cause permanent deformation of the strip material guided thereby. Such frame is supported at one end on the entry guide assembly E in such a manner that the arcuate path defined by the rolls 71 terminates in substantially tangential alignment with the entry to the oppositely curving helical path defined in the accumulator. The other end of the frame 70 may be supported on and guided for movement along a rail or track 72 such as by captive flange rollers (not shown). Such rail 72 may be embedded in the foundation or otherwise fixed thereto and is parallel to the rail 28 on which rides the entry guide assembly E to permit radial movement of the entry roll guide 17 along with such guide assembly during radial inward and outward movement of the vertical frames.

One or more lower strip edge support rolls 73 may also be provided adjacent the entry end of the entry roll guide to support the strip. A pair of feed-in or pinch rolls 74 may also be provided, such pinch rolls being vertically aligned and spaced adjacent each other at the entry end of the entry roll guide and driven at a controlled speed by a motor (not shown).

The exit roll guide 18 may be constructed similarly to the entry roll guide 17, such exit roll guide including a fabricated frame 76, and an arcuate array of rolls 77. Also, one or more lower strip edge support rolls 78 and a pair of pinch rolls 79 may be provided adjacent the exit end of the exit roll guide. The frame 76 at one end is supported on the exit guide assembly O and guided and supported at its other end on a rail or track 80 that is parallel to the rail 28 for the exit guide assembly O. The pinch rolls 79 may be controllably driven by a motor (not shown) to provide a back tension for the mill. One of the pinch rolls preferably is fixed in position and directly connected to the motor whereas the other roll may be mounted in machine slides and connected to hydraulic cylinders or the like to provide a constant pinch pressure on the moving strip. The feed-in rolls 74 of the entry roll guide may be similarly arranged.

Operation

To initially load the accumulator, the strip material S may be fed initially from a coil C between the feed-in rolls 74 adjacent the entry roll guide 17 to provide the driving force for feeding the strip material into the accumulator to load the same. If the strip coil has its axis oriented horizontally as is typical, it will be necessary to turn the strip 90° from the horizontal to vertical before passing through the pinch rolls as indicated at 82 in FIG. 1. The distance required for this turning operation must be sufficient to prevent any permanent deformation of the material. As such distance typically will be relatively long, intermediate strip turning stands (not shown) should be provided to support and guide the strip material at selected intervals through such turning distance. In addition, the strip material leaving the strip coil initially may be fed through an uncoiler to straighten same prior to being fed into the accumulator.

From the feed-in rolls 74, the strip material S is guided by the entry guide rolls 71 into the accumulator at the entry guide basket assembly E. From the entry guide basket assembly, the strip material is passed through the helically arranged guide roll assemblies 16 of the guide basket assemblies 11, and hence along the helical strip path defined thereby. Strip material is fed into the accumulator until the leading edge of the coil reaches the end of the helical strip path at the exit guide basket assembly O whereupon the strip material is guided along the exit guide rolls 77 to and between the pinch rolls 79 and then on to the mill, machine or other apparatus for processing of the strip material. If such start-up operation is performed with the guide basket assemblies in their radially expanded condition, the accumulator would then be fully loaded. Otherwise, additional strip material may be fed into the accumulator as the guide basket assemblies are radially expanded to the phantom position shown in FIGS. 1 and 2, at which time the accumulator is filled to maximum capacity.

During normal operation, the accumulator is maintained in its radially expanded condition, and strip material is fed into the accumulator at approximately the same rate at which strip material is removed therefrom. However, should the rate of withdrawal of the strip material from the accumulator exceed the rate of in-feed, or the in-feed be stopped altogether, as when welding on a new coil to replenish the supply of strip material, the reserve capacity of the accumulator will still permit withdrawal of the strip material without interruption. During such welding operation, the feed-in rollers 74 are stopped and the guide basket assemblies 11 are permitted to move uniformly radially inwardly to reduce the diameter of the stored turns so as to supply from storage the additional required length of strip material. By proper selection of the size of the strip accumulator in relation to the speed of the mill processor or the like and the time required to weld on a new coil, the accumulator will be able to supply sufficient strip material to prevent interruption of the line during the welding operation. Of course, if the amount of additional strip material required should exceed the storage capacity of the accumulator, a suitable emergency stop should be provided to shut down the strip processing line at the appropriate time.

After a new coil has been welded on or otherwise attached to the tail end of the spent coil, strip material again is fed into the accumulator by the feed-in rollers 74 which are then driven at a linear speed greater than that of the strip material being withdrawn. The rate of withdrawal is of course governed by the mill, processor or the like to which the strip material is being fed. As long as the rate of in-feed of the strip material is greater than the out-feed, the guide basket assemblies 11 may be uniformly expanded through operation of the drive motor 58. Such higher rate of in-feed may be continued until the accumulator is once again filled to capacity with the guide basket assemblies at their radially outermost positions shown in FIGS. 1 and 2 in phantom lines. At that time the rate of in-feed of the strip material into the accumulator should be adjusted substantially to correspond to the rate of withdrawal therefrom so as to maintain the maximum reserve of strip material for the next interruption of the in-feed or until the in-feed is stopped altogether to replenish the source of supply.

It will be appreciated that the difference between the length of strip material S when the guide basket assemblies 11 are fully expanded to the position seen in phantom lines in FIGS. 1 and 2 and when fully contracted to the position seen in solid lines in FIGS. 1 and 2 determines the maximum reserve stroage capacity of the accumulator.

Although the invention has been shown and described with respect to a preferred embodiment, it is obvious that equivalent alterations and modifications will occur to others skilled in the art upon the reading and understanding of the specification. The present invention includes all such equivalent alterations and modifications, and is limited only by the scope of the following claims.

What is claimed is:

1. An accumulator for storing a variable length of elongated strip material comprising a plurality of circumferentially arranged strip guide means positively defining a spiral path for the strip material with adjacent turns thereof being maintained in spaced relation, and means for uniformly moving said guide means to effect radial expansion and contraction of the sprial strip path, whereby a reserve capacity of strip material may be stored and withdrawn as needed, each said strip guide means including a radially movable support frame having mounted thereon at least one of a plurality of strip guides which together support and guide the strip material along such spiral path.

2. The accumulator of claim 1 wherein each said strip guide includes a vertical guide roll about which the strip material passes and a radial roll supporting the lower edge of the strip material.

3. The accumulator of claim 1 wherein each said strip guide includes a pair of closely radially spaced vertical rolls and a radial roll at the lower ends of and spanning said vertical rolls for supporting, containing and guiding the strip material therepast along such spiral path.

4. The accumulator of claim 1 wherein said strip guides are vertically spaced apart on those support frames having more than one strip guide mounted thereon whereby adjacent turns of the strip material are of substantially the same diameter and vertically spaced apart to define a helical path for the strip material.

5. The accumulator of claim 4 wherein each said support frame includes a vertical column on which said strip guides are mounted.

6. The accumulator of claim 5 wherein each said support frame is mounted for radial movement on a rail, and including means for holding each said support frame to said rail to maintain the vertical column of said support frame upright.

7. The accumulator of claim 1 wherein each said support frame is mounted for radial movement on a radially extending rail.

8. The accumulator of claim 1 wherein said means for uniformly moving includes a drive for each said support frame and a single drive motor common to said drives.

9. The accumulator of claim 8 wherein each said drive includes a capstan and bi-directional cable means interconnecting each said capstan to the corresponding support frame for effecting radial movement of said support frames upon rotation of said capstan.

10. The accumulator of claim 1 wherein said means for uniformly moving includes means operative to move said support frames radially outwardly and for placing a drag on said support frames during radially inward movement thereof.

11. The accumulator of claim 1 wherein such spiral strip path includes an entry and exit, and including feed-in means for feeding incoming strip material into such spiral path at said entry and withdrawal means for withdrawing strip material from such spiral path at said exit.

12. The accumulator of claim 11 wherein said feed-in or withdrawal means includes a pair of pinch rollers.

13. The accumulator of claim 11 wherein said feed-in or withdrawal means includes means for guiding the strip material into or out of the accumulator along an arcuate path that is curved opposite such spiral path and terminates in tangential alignment with the spiral path at said entry or exit.

14. The accumulator of claim 13 wherein said feed-in or withdrawal means includes a radially movable entry or exit frame and said means for guiding the strip includes an arcuate array of vertical rolls mounted on said entry or exit frame.

15. The accumulator of claim 14 wherein said entry or exit frame is connected to said support frame at said entry or exit for common radial movement therewith.

16. The accumulator of claim 15 wherein said support frame at said entry or exit and said entry or exit frame are mounted for radial movement on respective parallel rails.

17. An accumulator for storing a variable length of elongated strip material comprising a plurality of circumferentially spaced vertical support frames each supporting at least one of a plurality of strip guides which together support, contain and guide the strip material along a helical path consisting of one or more turns having substantially the same diameter, and means for uniformly radially moving said vertical support frames in opposite directions to radially expand and contract such helical path whereby a reserve capacity of strip material may be stored and withdrawn as needed.

18. The accumulator of claim 17 wherein each said strip guide includes a pair of closely radially spaced vertical rolls and a radial roll at the lower ends of and spanning said vertical rolls for supporting, containing and guiding the strip material therepast along such spiral path.

19. The accumulator of claim 17 wherein each said vertical support frame is mounted for radial movement on a rail, and including means for holding said vertical support frame to said rail to maintain said vertical support frame upright.

20. The accumulator of claim 17 wherein said means for uniformly radially moving includes a drive for each such vertical support frame and a single drive motor common to said drives.

21. The accumulator of claim 20 wherein each said drive includes a capstan and bi-directional cable means interconnecting each said capstan to the corresponding vertical support frame for effecting radial movement of said vertical support frames upon rotation of the capstan.

22. A method of storing a variable length of elongated strip material comprising the steps of:

(a) forming the strip material into a helix and maintaining adjacent turns thereof in vertically spaced apart relationship at discrete circumferentially spaced locations, (b) supporting and guiding the strip material along the helical path thus defined, and (c) positively uniformly moving the strip material radially at such discrete circumferentially spaced locations to radially expand and contract the helical path thereby to vary the length of strip material stored in such helix.

23. An accumulator for storing a variable length of elongated strip material comprising a plurality of circumferentially spaced strip guide means for supporting, containing and guiding the strip material along a helical path consisting of more than one turn, said strip guide means maintaining adjacent turns of the strip material in spaced apart relationship at discrete circumferentially spaced locations along such helical path, and means for uniformly radially moving said strip guide means in opposite directions to radially expand and contract such helical path at such discrete circumferentially spaced locations thereby to vary the length of strip material stored in such helical path.

24. The accumulator of claim 23 wherein said strip guide means includes means for maintaining adjacent turns of the strip material in vertically spaced apart relationship.

25. A method of storing a variable length of elongated strip material comprising the steps of:

(a) forming the strip material into a helical path consisting of more than one turn and maintaining adjacent turns in spaced apart relationship at discrete circumferentially spaced locations, (b) supporting and guiding the strip material along the helical path thus defined, and (c) positively uniformly moving the strip material radially at such discrete circumferentially spaced locations to radially expand and contract the helical path thereby to vary the length of strip material stored in such helical path.

* * * * *